US007975949B2

(12) United States Patent
Orphall et al.

(10) Patent No.: US 7,975,949 B2
(45) Date of Patent: Jul. 12, 2011

(54) HAMMER ASSEMBLY FOR A ROTARY MATERIAL CRUSHER

(76) Inventors: Gregory Kurt Orphall, Venetia, PA (US); Gregory George Kratofil, Pittsburgh, PA (US)

( * ) Notice: Subject to any disclaimer, the term of this patent is extended or adjusted under 35 U.S.C. 154(b) by 230 days.

(21) Appl. No.: 12/504,987

(22) Filed: Jul. 17, 2009

(65) Prior Publication Data

US 2010/0019075 A1 Jan. 28, 2010

Related U.S. Application Data

(60) Provisional application No. 61/137,034, filed on Jul. 25, 2008.

(51) Int. Cl.
*B02C 13/09* (2006.01)

(52) U.S. Cl. ..... 241/189.1; 241/195; 241/294

(58) Field of Classification Search ..... 241/189.1, 241/294, 195
See application file for complete search history.

(56) References Cited

U.S. PATENT DOCUMENTS

| | | | | |
|---|---|---|---|---|
| 6,880,774 | B2 * | 4/2005 | Bardos et al. | 241/189.1 |
| 7,469,852 | B2 * | 12/2008 | Sharp | 241/236 |
| 2004/0251360 | A1 * | 12/2004 | Everson et al. | 241/294 |
| 2005/0001084 | A1 * | 1/2005 | Pizzuto | 241/294 |
| 2005/0035234 | A1 * | 2/2005 | Roozeboom et al. | 241/195 |
| 2006/0243840 | A1 * | 11/2006 | Latham | 241/294 |
| 2008/0142625 | A1 * | 6/2008 | Doppstadt | 241/194 |

* cited by examiner

*Primary Examiner* — Bena Miller
(74) *Attorney, Agent, or Firm* — Kratz, Quintos & Hanson, LLP

(57) ABSTRACT

A hammer assembly for attachment to a rotor of a rotary material crusher. The hammer assembly has an adaptor, having a base portion and a hammer mounting portion, with the base portion being attachable to the rotor at the periphery portion and a hammer, having at least one impact portion, for crushing material, and a mounting portion for engagement with the hammer mounting portion of the adaptor. The hammer mounting portion of the adaptor includes bearing surfaces facing a direction of impact when crushing material, and the mounting portion of the hammer includes bearing surfaces for mating with the bearing surfaces of the hammer mounting portion of the adaptor. The hammer assembly further includes a retainer rod, and at least one retainer pin. The hammer is attached to the adaptor and the retainer rod passes through apertures of the adaptor and apertures of each retainer pin in the direction of the longitudinal axes of the hammer and the adaptor. The size of the retainer rod, the size of the apertures of the adaptor and the size of the aperture of each retainer pin are selected such that the hammer is free to move to enable the bearing surfaces of the hammer to bear on the bearing surfaces of the adaptor and transfer impact forces when impact forces from crushing material are applied, with the retainer rod being free from any of the impact forces.

2 Claims, 10 Drawing Sheets

HAMMER ASSEMBLY FOR A ROTARY MATERIAL CRUSHER

The present application claims priority under 35 U.S.C. 119(e) of U.S. Provisional Application Ser. No. 61/137,034 filed Jul. 25, 2008.

This invention is concerned with a hammer assembly for attachment to a rotor of a rotary material crusher. In particular this invention is concerned with a hammer assembly which reduces the time and the difficulty normally associated with replacing worn hammers of a rotary material crusher.

In rotary material crushers, a rotor having hammers attached to a peripheral portion of the rotor are driven to rotate at speeds from 300 to 800 rpm, which translates to linear speeds for the hammers from 5000 to 7000 feet per minute, so as to have the hammers impact material such as limestone, and the like, in order to reduce the size of the material. Such crushing of material generates high impact forces on the hammers, which are in turn transferred to the rotor. In view of the high impact forces, it is important to provide a robust means for attaching the hammers to the rotor, but at the same time providing an attaching mean which enables the hammers to be easily removed and replaced when excessive wear to the hammers causes them to be unusable.

Conventional means for attaching the hammers to the rotor, such as bolts, or the like, have been found to be undesirable, as the above-described impact forces, besides acting on solely the hammers, also act on the attaching means in a manner that makes removal of conventional means difficult and time consuming.

Another consideration in providing a means of attaching the hammers to the rotors, is to provide a means which enables replacement of the hammers without requiring removal of the rotor from the rotary crushing machine, and without requiring a large opening in side plates, or the like, of the machine, that are positioned adjacent ends of the rotor.

Another consideration in providing a means of attaching the hammers to the rotor, is to provide proper means for transferring the tremendous impact forces from the hammers to the rotor by positioning any bearing surfaces of the attachment mean at the proper orientation in relation to the direction of the impact forces.

The present invention takes into account the above-discussed considerations and provides a means for attaching a hammer to a rotor, which reduces the time and difficulty for replacing the hammers found in prior attachment means and at the same time provides a robust attachment that is able to withstand the tremendous impact forces found in a rotary crushing machine.

The present invention will be more clearly understood from the following description of a preferred embodiment of the invention, which is disclosed with use of the appended drawings. In the drawings.

Figure 1:
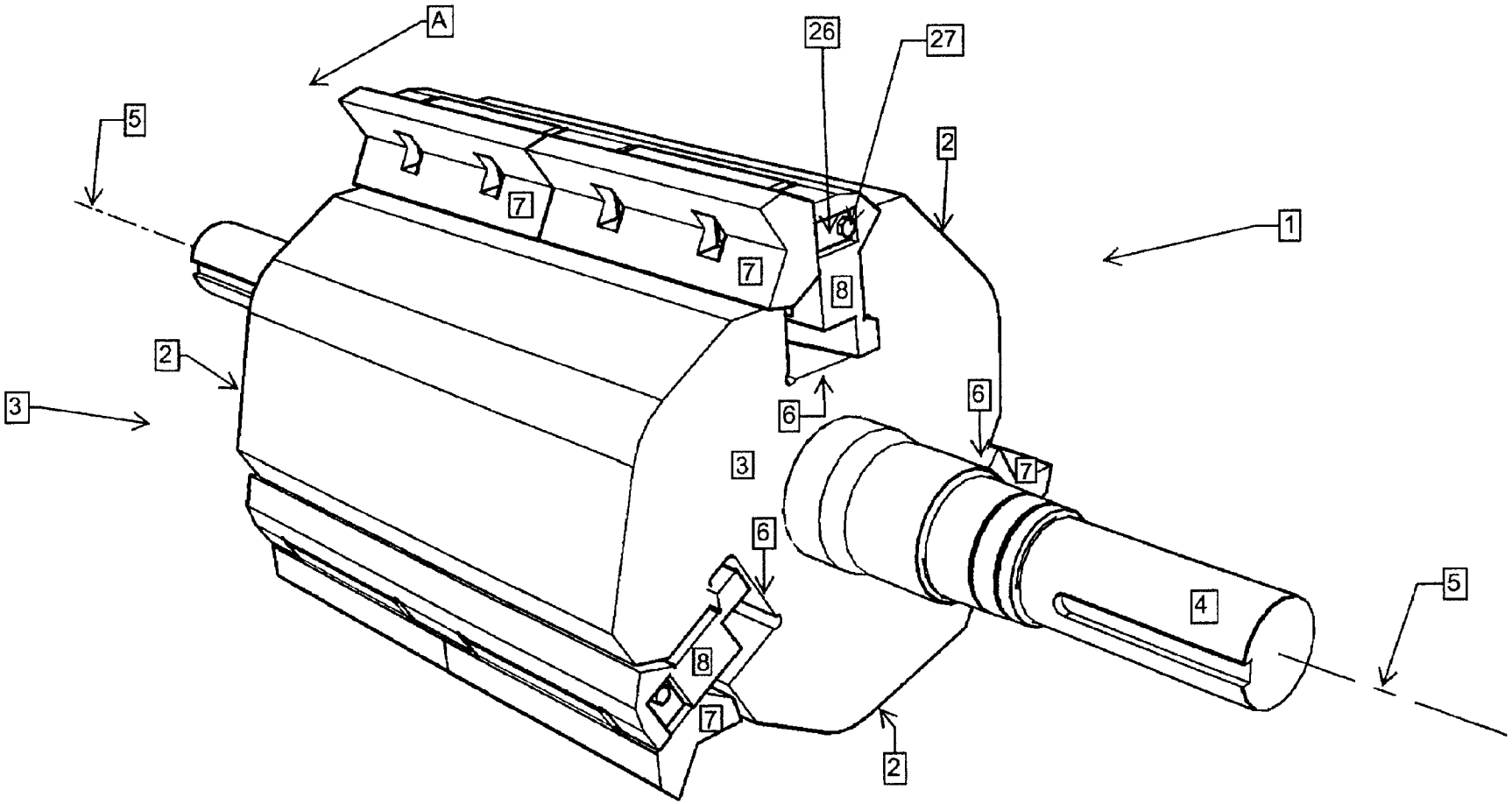
FIG. 1 is a perspective view of an embodiment of the invention mounted to a rotor of a rotary material crusher.

FIG. 1 shows a rotor (1) of a rotary material crusher. The rotor has a generally cylindrical shape with a peripheral portion, indicated at (2), and opposing ends (3). A shaft (4) penetrates through the rotor body and extends from each end of the rotor into bearings of the rotary material crusher, and a means for rotating the rotor is provided on at least one of the shafts for connection to a means for driving the rotor. An axis of rotation (5) is shown extending through the shafts and rotor.

Disposed at the peripheral portion of the rotor are at least two attachment grooves (6) for use in attaching at least two hammers (7) to the rotor. In the embodiment of FIG. 1, three pairs of hammers are attached to the rotor. In the following disclosure only one hammer of a hammer assembly will be described, however it is to be understood that any number of attachment grooves (6) can be disposed circumferentially around the rotor, and any number of hammers (7) can be attached along the attachment groove (6). To have attachment grooves disposed in the peripheral portion of a rotor is known in the art.

In use of the rotary material crusher, in view of the tremendous impact from the material and the abrasive nature of the material being crushed by the hammers (7), it is necessary to periodically replace the hammers because of extensive wear at the impact surface, which eventually renders the hammer unusable. In certain embodiment it is possible to merely reverse the orientation of the hammers, in relation to the direction of rotation of the rotor, to expose a fresh impact surface, if the hammers are provided with a second impact surface. The present invention can accommodate a hammer having a second impact surface and the hammer shown in the drawings has a second impact surface.

Figure 2:
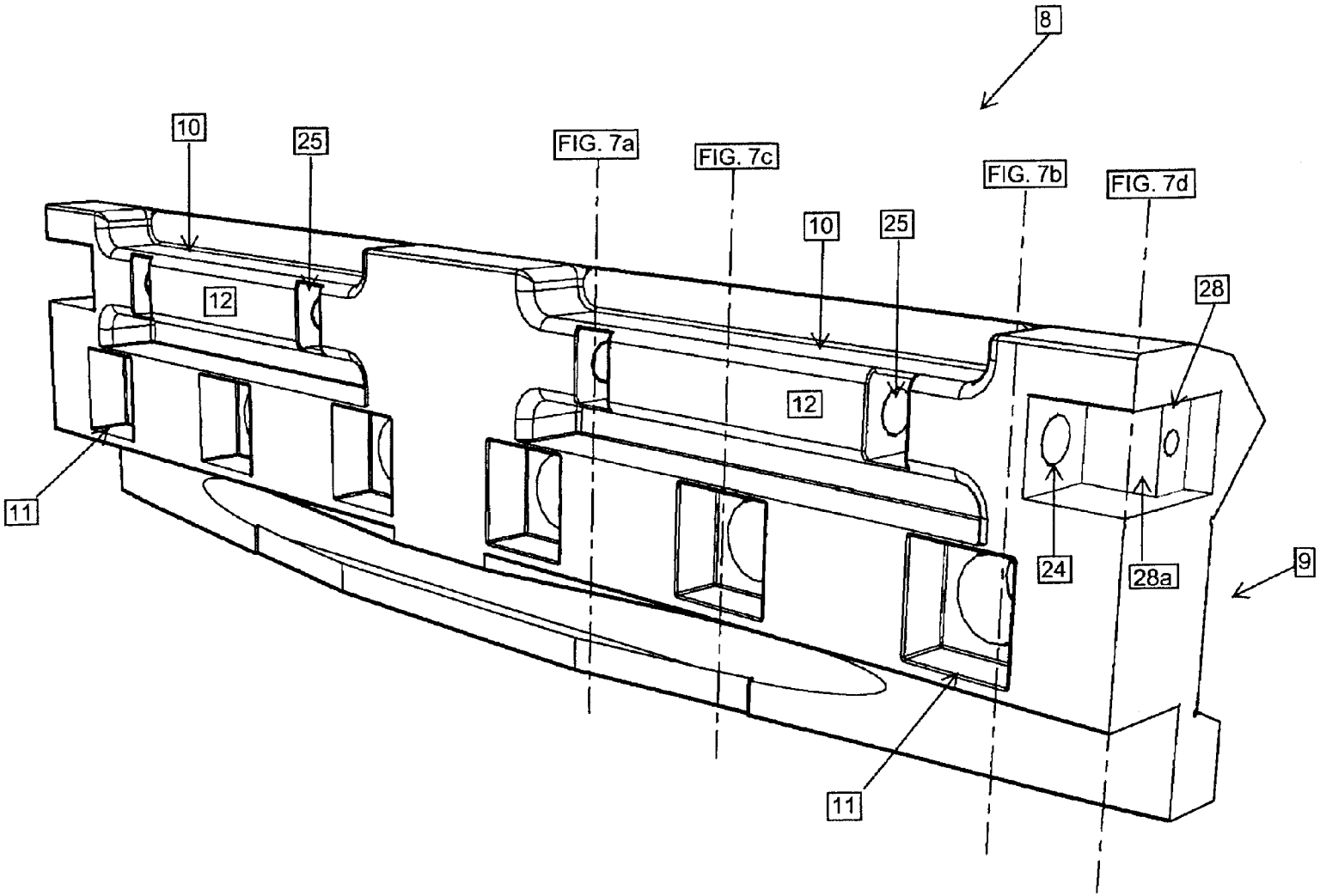
FIG. 2 is an adaptor of the invention for engaging a hammer of the invention to attach the hammer to the rotor.

In the present invention an adaptor (8), shown attached to the rotor in FIG. 1 and shown in perspective and unattached in FIG. 2, is attached to the rotor in attachment groove (6). The adaptor (8) is made up of a base portion (9) and a hammer mounting portion (10), as indicated in FIG. 2. The base portion (9) seats in attachment groove (6), as shown in FIG. 1, and can be secured to the rotor by any known means. As shown in FIG. 2, bolt holes, such as those shown at (11), can be used for securing the adaptor to the rotor along with wedging elements, or the like. The means for attaching the adaptor to the rotor is not a feature of the present invention. The feature of the present invention can be used along with any means of attaching the base portion (9) of the adaptor to the rotor.

In use of the present invention, the adaptor remains on the rotor during periodic replacement of the hammer, thus reducing the time and labor required for replacing the hammer.

When the adaptor is attached to the rotor, the hammer mounting portion (10) of the adaptor, preferably extends outward in a substantially radial direction in relation to the axis of rotation (5). The adaptor shown in FIGS. 1 and 2 is configured to accommodate two hammers, as shown in FIG. 1, however an adaptor of the invention can be configured to accommodate solely one hammer, or more than two hammers.

The hammer mounting portion (10) of the adaptor includes a ridge (12) extending in the direction of a longitudinal axis of the adaptor. The hammer is configured to mate with ridge (12).

Figure 3:
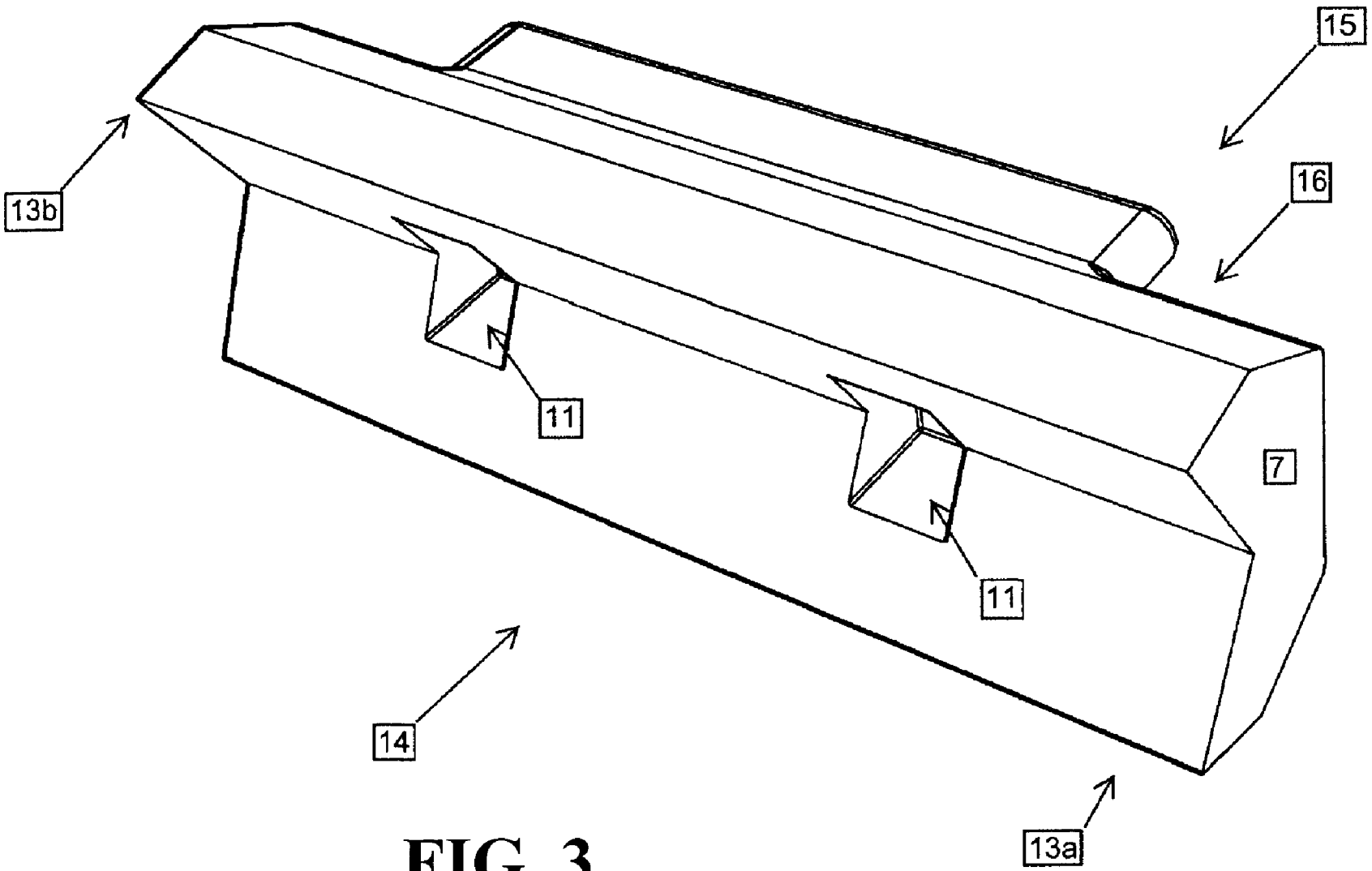
FIG. 3 is a hammer of the invention.

FIG. 3 shows a hammer of the invention having impact surfaces (13*a*) and (13*b*). The preferred embodiment of the invention features a hammer with two impact surfaces, to enable reversing of the orientation of the hammer when one of the surfaces is worn.

Figure 6:
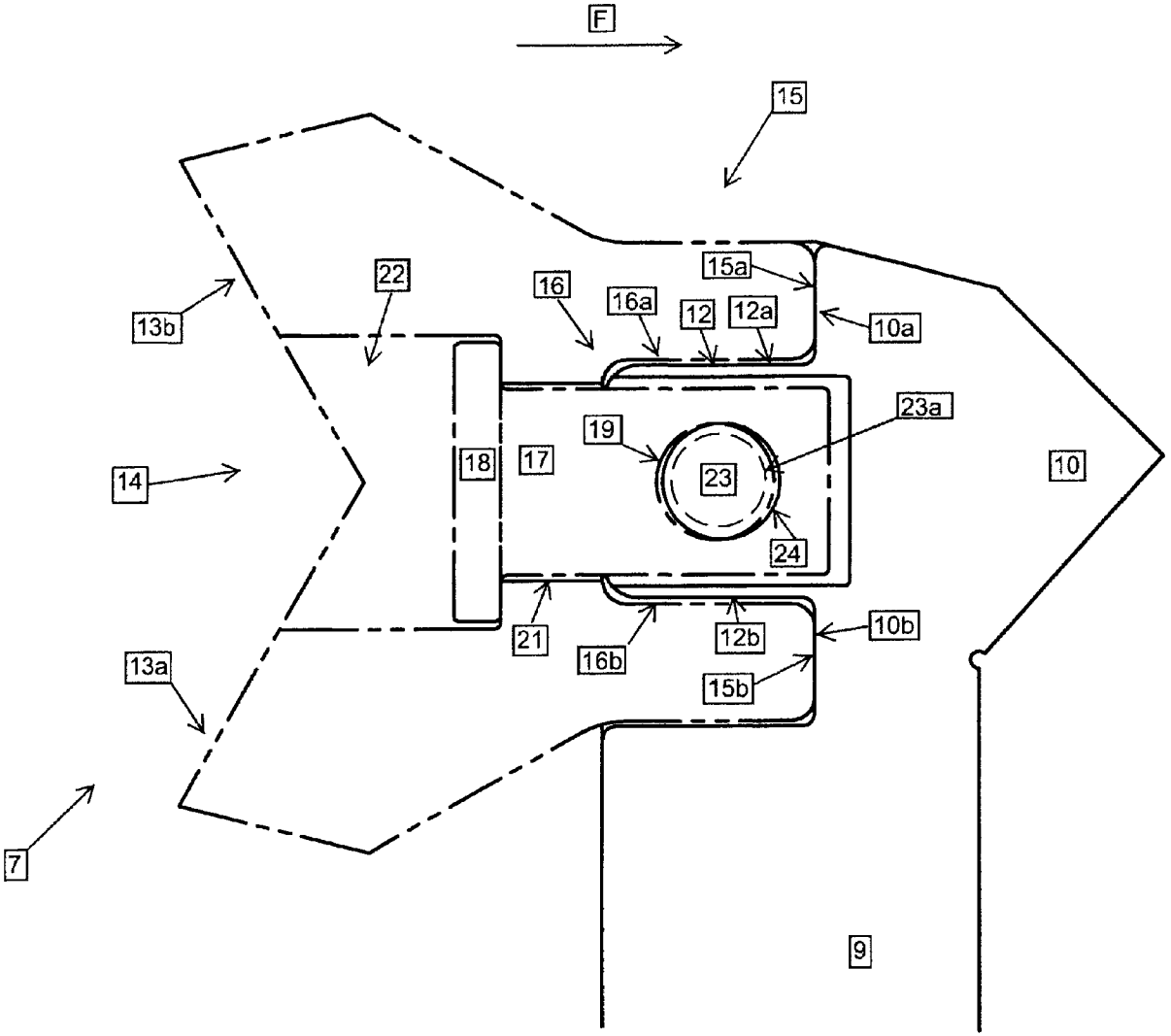
FIG. 6 is an end view of the hammer assembly of the invention for showing relative sizes of apertures and the retainer rod.

The two impact surfaces are disposed at an impact portion (14) of the hammer. Opposed to the impact portion is a mounting portion (15) of the hammer, for engagement with the hammer mounting portion (10) of the adaptor. The mounting portion (15) of the hammer includes a grooved portion (16), partially shown in FIG. 3, but better shown in FIG. 6. FIG. 6, a cross-sectional view in a direction perpendicular to longitudinal axes of the hammer and the adaptor, shows hammer (7), adaptor (8) and retainer pin (17), which is described below. As shown in FIG. 6, when the hammer (7) is mounted to the adaptor (8), the grooved portion (16) of the hammer mates with the ridge (12) of the adaptor, to form a tongue and groove type arrangement. Surfaces of the ridge of the adaptor and surfaces of the groove of the hammer, which oppose each other when the hammer is mounted, are oriented such that surfaces (12*a*) and (12*b*) of the ridge of the adaptor and surfaces (16*a*) and (16*b*) of the grooved portion of the hammer face substantially in the direction of centrifugal forces resulting from the rotation of the rotor. Also, surfaces (10*a*) and (10*b*) of the hammer mounting portion of the adaptor, and surfaces (15*a*) and (15*b*) of the mounting portion of the hammer face substantially in the direction of impact forces resulting from the impact of the material being crushed by the impact surfaces (13*a*) or (13*b*) of the hammer. Additional surfaces, which are opposed to each other are described below.

The above-mentioned impact forces must be seriously considered as they are of a high magnitude, and any means for retaining the hammer on the adaptor must be able to remain in a condition that makes removal of the retainer means still possible after being subjected to the impact forces over a period of time.

Figure 4:
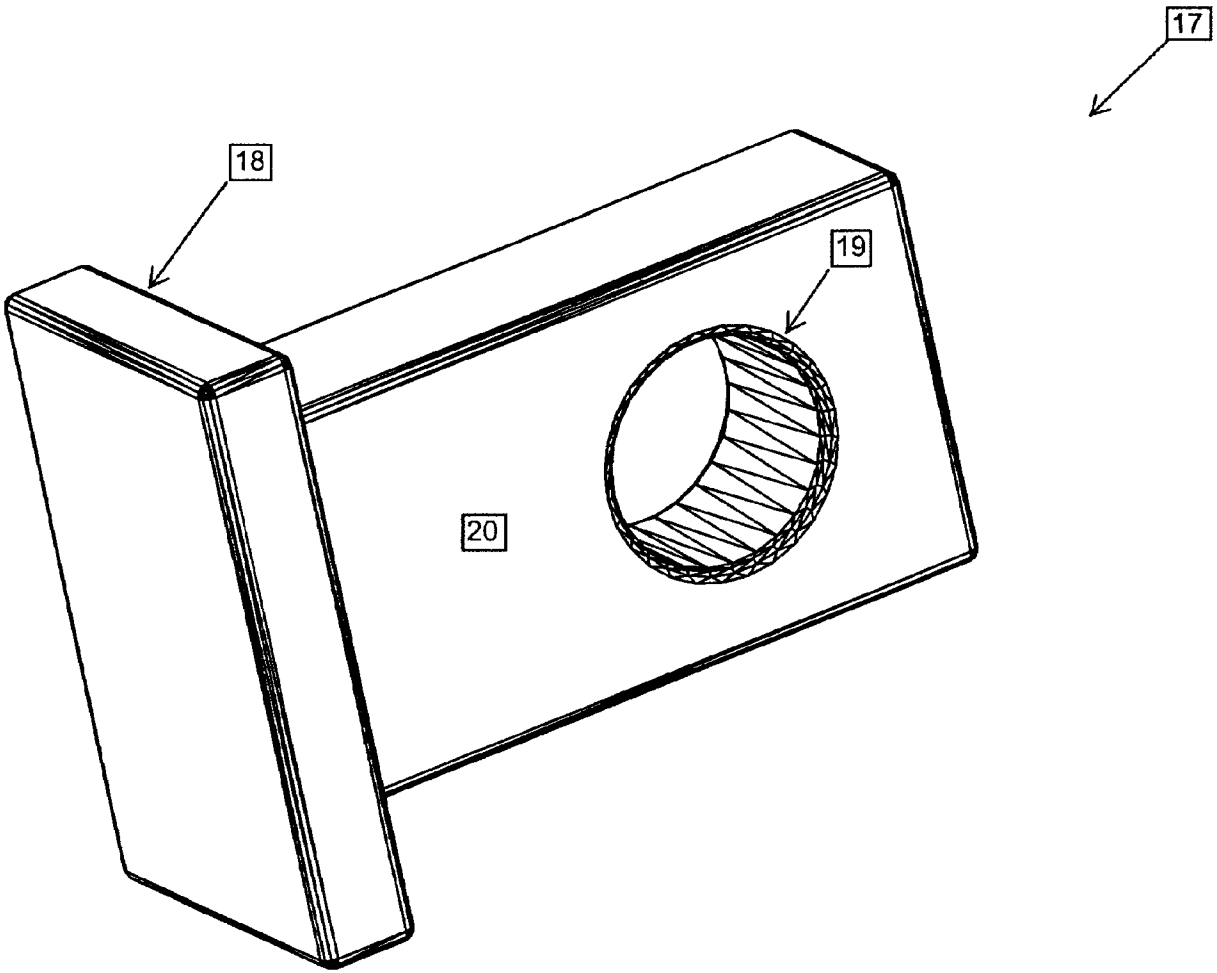
FIG. 4 is a retainer pin of the invention.

FIG. 6 shows hammer (7) mounted on adaptor (8), along with a retainer pin (17). The retainer pin is shown in perspective in FIG. 4. Referring to FIG. 4, the retainer pin includes an end having head (18) and another end having an aperture (19). A body (20) of the retainer pin is dimensioned to pass through an opening (21) in the hammer, as best shown in FIG. 6. Preferably the body(17) and the head end (18) have a rectilinear shape. Also, preferably the head end (18) of the retainer pin fits into a recessed portion (11) of the hammer so as to be at least partially protected from impact with material being crushed.

Figure 5:
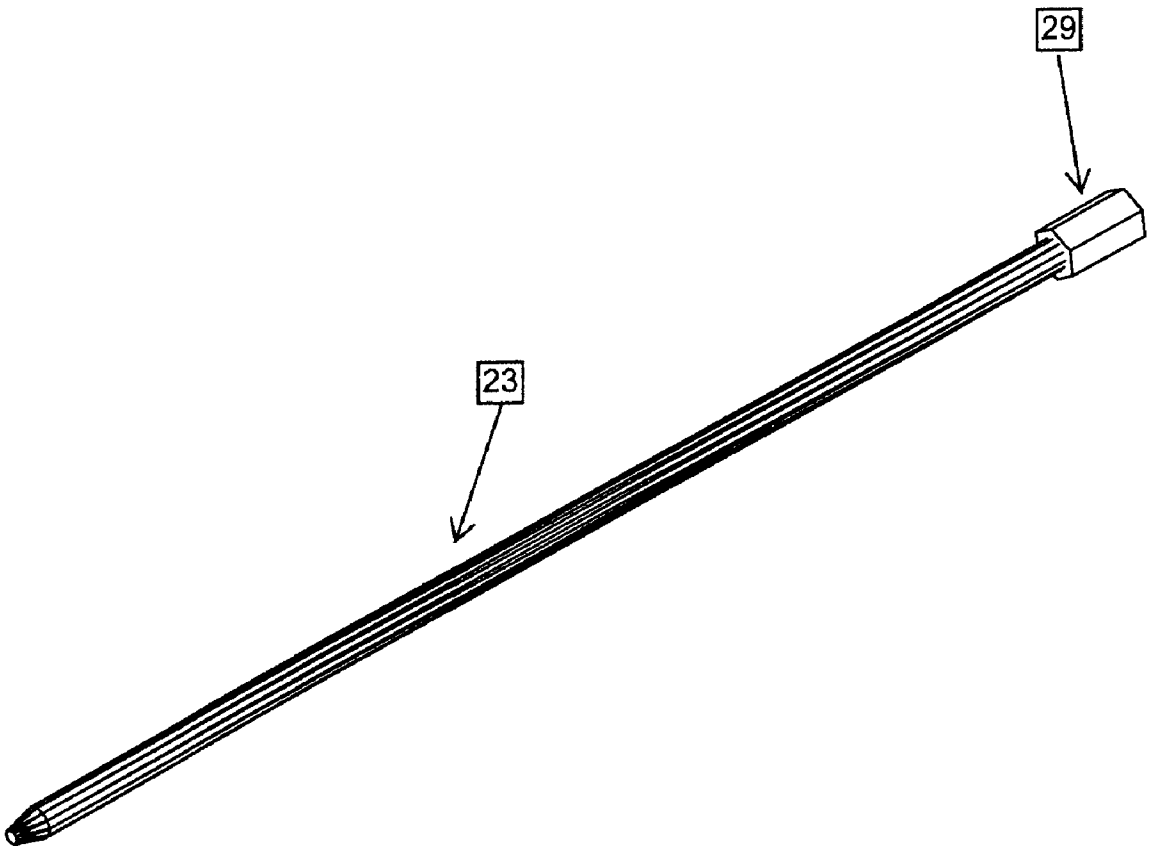
FIG. 5 is a retainer rod of the invention.

To retain the hammer on the adaptor, with use of the retainer pin, a retainer rod (23), shown in FIG. 6, and also shown in perspective in FIG. 5 is used. The retainer rod passes through the aperture (19) in the retainer pin, as well as through an apertures (24) in the hammer mounting portion of the adaptor, which is disposed in a direction of a longitudinal axis of the adaptor as shown in FIG. 2. The alignment of the retainer rod (23) through the aperture (19) of the retainer pin and the aperture (24) of the adaptor is shown in FIG. 6. In FIG. 6, the heavy dashed circle represents the aperture (19) of the retainer pin, the heavy solid circle represents the aperture (24) of the adaptor, and the light dashed circle (23*a*) represents the retainer rod (23).

The relative sizes and locations of the retainer rod and the apertures of the adaptor and retainer pins is an important feature of the invention. The retainer rod is dimensioned to pass, freely through the apertures without need of a press or driver, or the like. A preferred difference in diameters of the retainer rod (23) and the aperture (19) of the retainer pin and the aperture (24) of the adaptor is about 10 mils.

The location of the apertures (19) and (24) in relation to various surfaces of the hammer and adaptor are considered, as follow, in order that none of the impact force is applied to any portion of the retainer rod (23) or apertures (19) and (24). Such consideration is important so that when removal of the hammer is necessary, the retainer rod and apertures are not deformed in any way that would prevent the retainer rod from being easily pulled out of the apertures. Referring to FIG. 6, when the hammer impacts material being crushed, surfaces (15*a*) and (15*b*) of the hammer bear on surfaces (10*a*) and (10*b*) of the adaptor, to transfer the impact from the hammer to the adaptor, and in turn to the rotor. When the hammer is in the position shown in FIG. 6, relative to the adaptor, a clearance remains between the apertures (19) and (24), and the retainer rod (23), in the direction of impact force (F) so that no impact force is applied to the retainer rod. When the rotor is not in motion, the hammer may move in relation to the adaptor to separate surfaces (10*a*) and (10*b*) from (15*a*) and (15*b*), and thus apply a force on the retainer rod (23) resulting from the weight of the hammer, however such force does not deform the retainer rod in any manner.

Figure 7A:
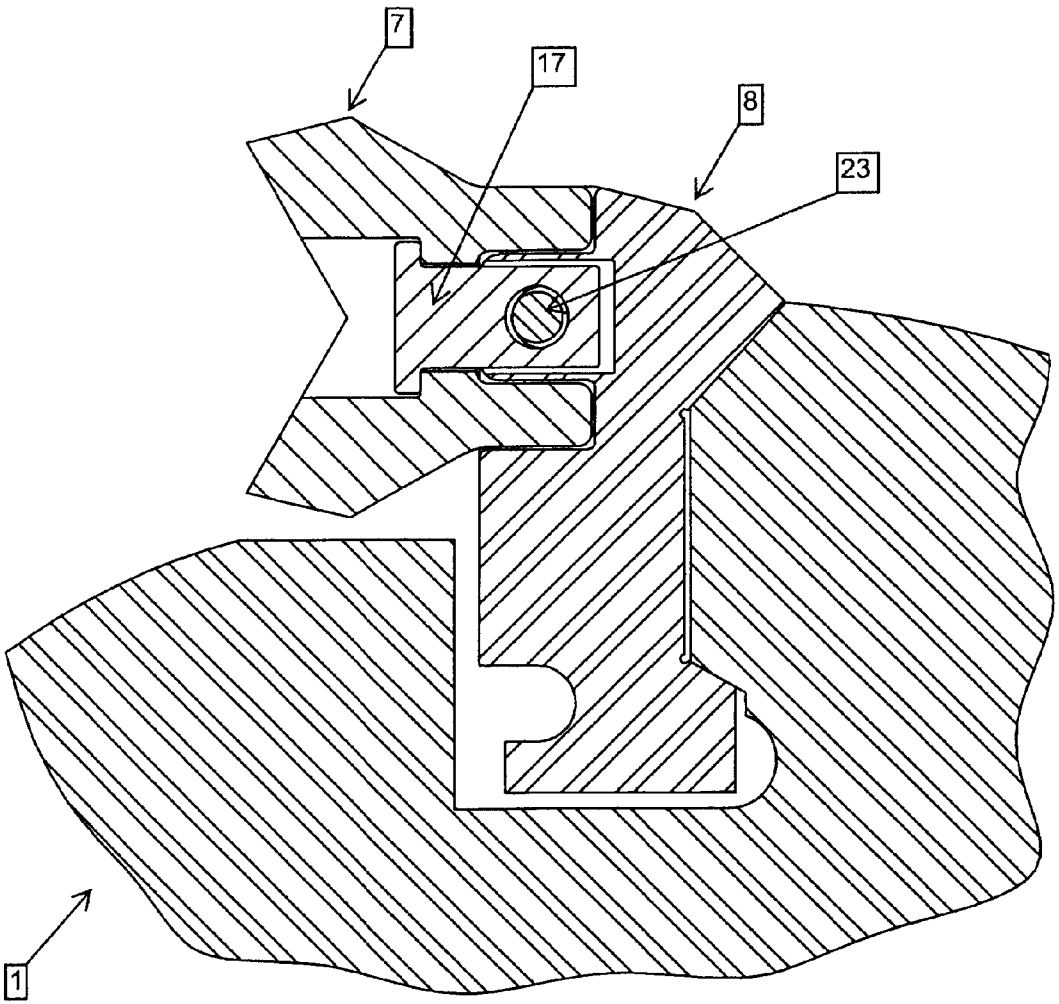
FIG. 7*a*-7*d* are cross-sectional views in various planes perpendicular to the longitudinal axes of the hammer and the adaptor for showing various features of the hammer assembly.
Figure 7B:
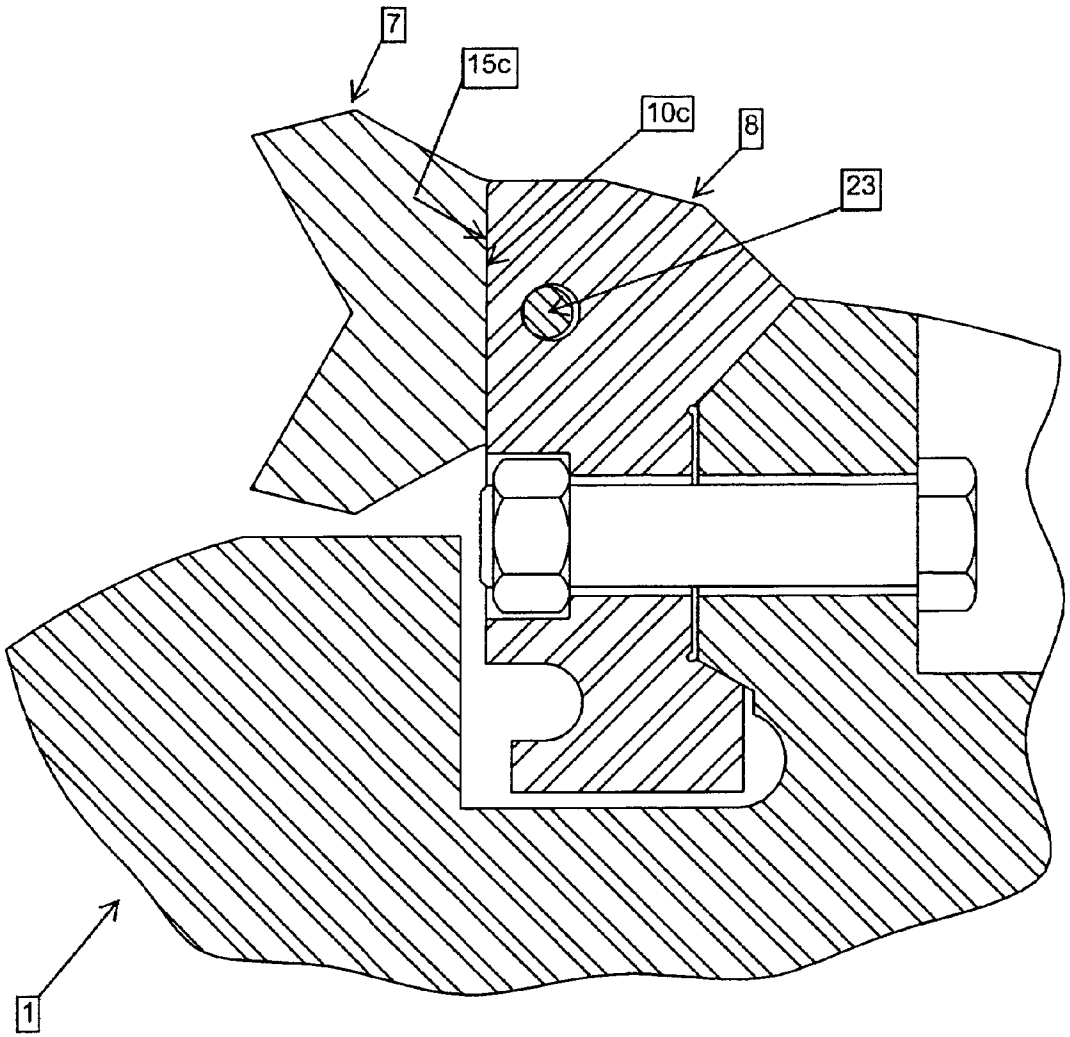
Figure 7C:
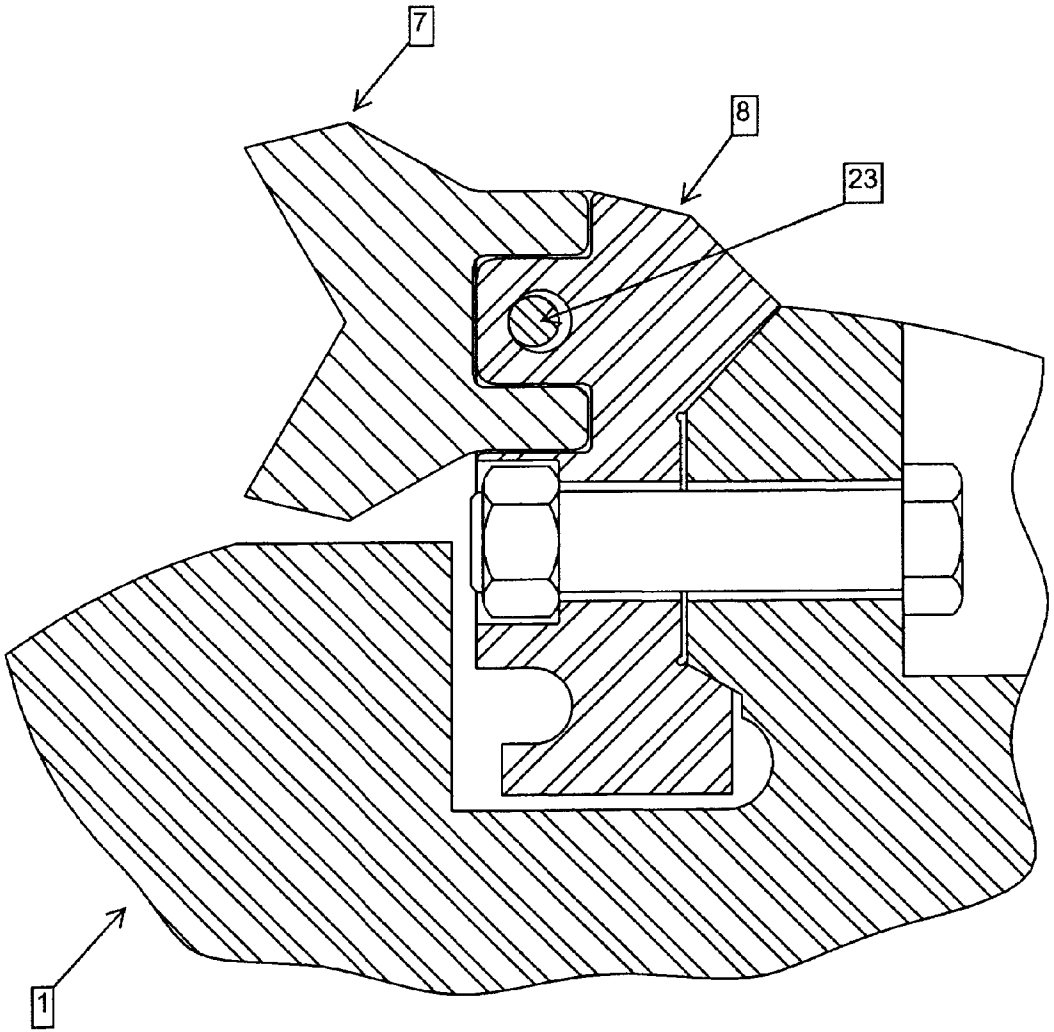
Figure 7D:
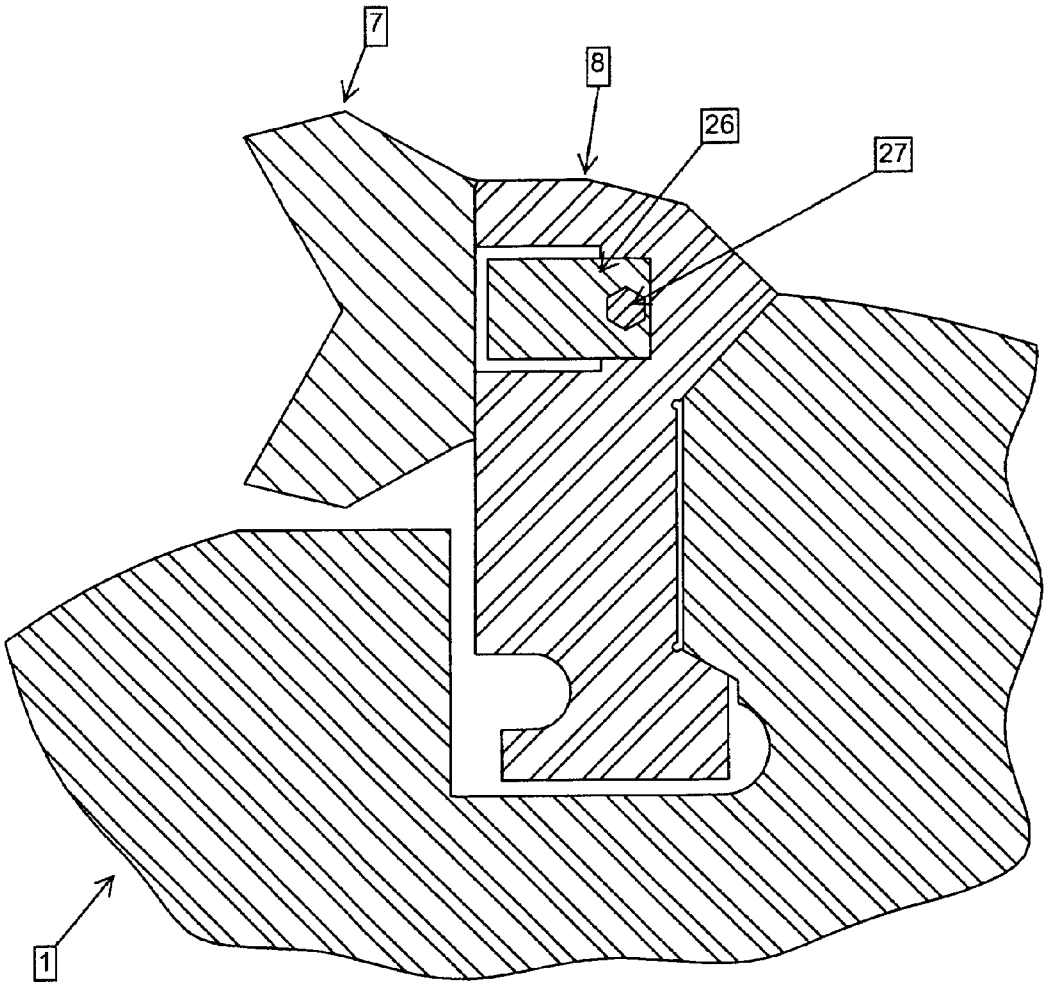

FIGS. 7*a*-7*d* show cross-sectional views of components of the hammer assembly at sections perpendicular to the longitudinal axes of the hammer, the adaptor, and the rotor. On FIG. 2 are dashed lines indicating the locations of the cross-sectional views shown in FIGS. 7*a*-7*d*. FIG. 7*a*, in general, corresponds to FIG. 6, however FIG. 7*a* includes a portion of the rotor (1). FIG. 7*a* is a cross-sectional view taken at a location of one of the retainer pins (17). FIG. 7*b* is a cross-sectional view taken at a location away from the retainer pin (17) and near an end of a hammer, for pointing out another surface of the adaptor (8) and hammer (7) which transfers the impact force from the hammer to the adaptor. Those surfaces are indicated at (10*c*) and (15*c*) and extend over a wider area than the surfaces described in relation to FIG. 6. The surface (10*c*) is in the same plane as surfaces (10*a*) and (10*b*). The surface (15*c*) is in the same plane as surfaces (15*a*) and (15*b*). FIG. 7*c* is a cross-sectional view taken between locations of the retainer pins. FIG. 7*d* is a cross-sectional view taken at an end of the hammer assembly and is discussed further, below.

As discussed above, retainer rod (23) is inserted through apertures (19) and (24) to retain the hammer on the adaptor. It is necessary to insert the retainer rod in a direction from one end of the rotor to the opposite end of the rotor, as shown in FIG. 1. However it is not necessary to remove the hammers by sliding them out in the same direction as for the retainer rod, as after the retainer rod is removed, the hammer can be removed by pulling it outwardly in a direction indicated by arrow (A) in FIG. 1. As mentioned above, a rotary crushing machine most often has side plates near ends of the rotor and access to end portions of the rotor are difficult.

In the present invention, only a small access hole in one of the side plates of the machine is required for use in mounting the hammer and removing the hammer when replacement is necessary. To mount the hammer (7) to the adaptor (8) the grooved portion (16) of the hammer is placed over the ridge (12) of the adaptor. Next, each retainer pin is inserted through the opening (21) in the hammer and further through retainer openings (25), as shown in FIG. 6, which are located in the ridge (12) of the adaptor. Next, the retainer rod (23) is inserted through an access opening in a side plate of the rotary crushing machine to pass in turn, through aperture (24) of the adaptor, aperture (19) in the retainer pin, aperture (24) of the adaptor, aperture (19) in the retainer pin, and aperture (24) of the adaptor. The above sequence would be repeated again for a hammer assembly as shown in FIG. 6, having a single adaptor and two or more hammers.

In order to keep the retainer rod in place, a keeper plate (26) as shown in FIGS. 1 and 7*d* is bolted into place. It is important that the keeper plate and bolt (27) be below the plane of the end of the rotor, so as not to make contact with the side plates of the machine which are disposed near ends of the rotor. As shown in FIG. 2, a keeper plate recess (28) is formed at an end of the adaptor to accommodate the keeper plate and bolt head.

To replace a hammer it is necessary to retract the retainer rod in a direction opposite to that described above for inserting the rod. To facilitate the retracting a threaded coupling (29), as shown in FIG. 5, is attached to the retainer rod prior to inserting the retainer rod when mounting the hammer to the adaptor. The threaded coupling can also be an integral part of the retainer rod. Preferably the threaded coupling has internal threads (female) into which an extraction tool (not shown), having external threads (male) of the same size and pitch can be threaded. After threading the extraction tool into the threaded coupling, force can be applied outwardly to remove the retainer rod from the hammer assembly.

With the attachment as described, the retainer rod can be rotated while applying the force to facilitate the extraction. By having internal threads on the threaded coupling, there is less chance that the threads will become damaged during operation of the machine. As shown in FIG. 2, an additional recess (28*a*) is formed in the end of the adaptor to accommodate the threaded coupling.

In a preferred embodiment, the adaptor has recesses (28) and (28*a*) in both ends to enable insertion of the retainer rod in either direction, as different rotary material crusher machines can be accessed easier on one side or the other.

The invention claimed is:

1. A hammer assembly for attachment to a rotor of a rotary material crusher, said rotor having a periphery portion and opposing ends, and being driven to rotate about an axis of rotation extending through the ends, said hammer assembly comprising:

an adaptor, having a base portion and a hammer mounting portion, with the base portion being attachable to said rotor at the periphery portion so as to align a longitudinal axis of the adaptor parallel to the axis of rotation of the rotor, said adaptor having apertures extending through the hammer mounting portion in a direction parallel to the longitudinal axis of the adaptor, with all apertures in alignment with each other, and a hammer, having at least one impact portion, for crushing material, and a mounting portion for engagement with the hammer mounting portion of the adaptor so as to align a longitudinal axis of the hammer parallel to the axis of rotation of the rotor, wherein the hammer mounting portion of the adaptor includes bearing surfaces facing a direction of impact when crushing material, and the mounting portion of the hammer includes bearing surfaces for mating with the bearing surfaces of the hammer mounting portion of the adaptor, the hammer assembly further comprising:

a retainer rod, and at least one retainer pin having one end with a head and an other end with an aperture, said end with an aperture for passing through an opening in the hammer and said end with a head for engaging with the hammer at said opening in the hammer, wherein when the hammer is attached to the adaptor, the retainer rod passes through the apertures of the adaptor and the apertures of each retainer pin in the direction of the longitudinal axes of the hammer and the adaptor, and the size of the retainer rod, the size of the apertures of the adaptor and the size of the aperture of each retainer pin are selected such that the hammer is free to move to enable the bearing surfaces of the hammer to bear on the bearing surfaces of the adaptor and transfer impact forces when impact forces from crushing material are applied, with said retainer rod being free from any of the impact forces.

2. The hammer assembly of claim 1, wherein said retainer rod includes a threaded coupling with internal threads.

* * * * *